US010227982B2

(12) United States Patent
Iitsuka et al.

(10) Patent No.: US 10,227,982 B2
(45) Date of Patent: Mar. 12, 2019

(54) SCROLL COMPRESSION DEVICE

(75) Inventors: Satoshi Iitsuka, Gunma-ken (JP); Tsutomu Kon, Gunma-ken (JP); Akihiro Hayashi, Gunma-ken (JP); Kenji Aida, Gunma-ken (JP); Kazuyoshi Sugimoto, Gunma-ken (JP); Yasunori Kiyokawa, Gunma-ken (JP); Yoshihiko Nagase, Gunma-ken (JP); Katsuki Akuzawa, Gunma-ken (JP); Yoshiaki Nagasawa, Gunma-ken (JP)

(73) Assignee: PANASONIC INTELLECTUAL PROPERTY MANAGEMENT CO., LTD., Osaka-shi (JP)

( * ) Notice: Subject to any disclaimer, the term of this patent is extended or adjusted under 35 U.S.C. 154(b) by 812 days.

(21) Appl. No.: 14/007,196

(22) PCT Filed: Dec. 20, 2011

(86) PCT No.: PCT/JP2011/079468

§ 371 (c)(1),
(2), (4) Date: Oct. 24, 2013

(87) PCT Pub. No.: WO2012/127754

PCT Pub. Date: Sep. 27, 2012

(65) Prior Publication Data

US 2014/0056736 A1 Feb. 27, 2014

(30) Foreign Application Priority Data

Mar. 24, 2011 (JP) ..... 2011-065607
Mar. 25, 2011 (JP) ..... 2011-066920
(Continued)

(51) Int. Cl.
*F04C 23/02* (2006.01)
*F04C 23/00* (2006.01)
(Continued)

(52) U.S. Cl.
CPC ..... *F04C 23/02* (2013.01); *F04C 2/025* (2013.01); *F04C 18/0215* (2013.01);
(Continued)

(58) Field of Classification Search
CPC ..... F04C 2/025; F04C 29/02; F04C 23/008; F04C 29/028; F04C 18/0215; F04C 23/02
See application file for complete search history.

(56) References Cited

U.S. PATENT DOCUMENTS 4,496,293 A 1/1985 Nakamura et al.
5,873,710 A * 2/1999 Tucker ..... 417/410.5
(Continued)

FOREIGN PATENT DOCUMENTS

CN 1480695 A 3/2004
CN 1550669 A 12/2004
(Continued)

OTHER PUBLICATIONS

Raw machine translation of JPS6075795 A, Chiyotani et al., "Compressing device of scroll type", Apr. 30, 1985.*
(Continued)

*Primary Examiner* — Charles Freay
*Assistant Examiner* — Lilya Pekarskaya
(74) *Attorney, Agent, or Firm* — Westerman, Hattori, Daniels & Adrian, LLP

(57) ABSTRACT

A scroll compression mechanism 11 for compressing refrigerant and a driving motor 13 that is connected to the scroll compression mechanism 11 through a driving shaft 15 and drives the scroll compression mechanism 11 are accommodated in a casing 3, the scroll compression mechanism 11 is supported in the casing 3 by a main frame 21, a stator 37 of the driving motor 13 is directly or indirectly supported in the casing 3, and the driving shaft 15 is connected to a rotor 39 of the driving motor 13 and supported in the casing 3 by a
(Continued)

bearing plate 8, and a lower end of the driving shaft 15 is supported by a thrust plate 6 provided to the bearing plate 8, and the center position of the rotor 39 is located to be lower than the center position of the stator 37.

4 Claims, 3 Drawing Sheets

(30) Foreign Application Priority Data

| | | |
|---|---|---|
| Mar. 25, 2011 | (JP) | 2011-066921 |
| Mar. 25, 2011 | (JP) | 2011-067051 |
| Mar. 28, 2011 | (JP) | 2011-069123 |
| Mar. 29, 2011 | (JP) | 2011-071324 |
| Mar. 29, 2011 | (JP) | 2011-071495 |

(51) Int. Cl.
*F04C 18/02* (2006.01)
*F04C 29/02* (2006.01)
*F04C 2/02* (2006.01)

(52) U.S. Cl.
CPC ..... *F04C 23/008* (2013.01); *F04C 29/02* (2013.01); *F04C 29/028* (2013.01); *F04C 2240/40* (2013.01); *F04C 2240/56* (2013.01); *F04C 2240/60* (2013.01)

(56) References Cited

U.S. PATENT DOCUMENTS

| | | | | |
|---|---|---|---|---|
| 2002/0033305 | A1* | 3/2002 | Koyama | F16N 7/36 184/6.16 |
| 2004/0040323 | A1 | 3/2004 | Yokozeki et al. | |
| 2004/0197213 | A1* | 10/2004 | Takemoto | 417/410.1 |
| 2005/0086960 | A1 | 4/2005 | Yokozeki et al. | |
| 2005/0210663 | A1 | 9/2005 | Ishida et al. | |
| 2005/0220652 | A1 | 10/2005 | Yamaji et al. | |
| 2006/0099086 | A1 | 5/2006 | Morozumi et al. | |
| 2008/0298986 | A1 | 12/2008 | Ishida et al. | |
| 2009/0238704 | A1* | 9/2009 | Sakamoto | F04C 18/0215 418/55.1 |
| 2012/0007455 | A1 | 1/2012 | Tanaka | |

FOREIGN PATENT DOCUMENTS

| | | | | |
|---|---|---|---|---|
| CN | 1638241 | A | | 7/2005 |
| CN | 1698249 | A | | 11/2005 |
| CN | 101145716 | A | | 3/2008 |
| EP | 1 956 244 | A2 | | 8/2008 |
| EP | 1956244 | A2 | * | 8/2008 |
| EP | 1 956 244 | A3 | | 10/2008 |
| EP | 2416013 | A1 | | 2/2012 |
| JP | 55-46081 | A | | 3/1980 |
| JP | 57-212389 | A | | 12/1982 |
| JP | 58-165907 | A | | 10/1983 |
| JP | 59-29785 | A | | 2/1984 |
| JP | 60-075795 | A | | 4/1985 |
| JP | 60075795 | A | * | 4/1985 |
| JP | 60-206998 | A | | 10/1985 |
| JP | 61-167354 | A | | 7/1986 |
| JP | 05-312157 | | | 11/1993 |
| JP | 11-132164 | A | | 5/1999 |
| JP | 11-275824 | A | | 10/1999 |
| JP | 11275824 | A | * | 10/1999 |
| JP | 11-341752 | A | | 12/1999 |
| JP | 2000-161268 | A | | 6/2000 |
| JP | 2001-41184 | A | | 2/2001 |
| JP | 2002-199670 | A | | 7/2002 |
| JP | 2003-035289 | A | | 2/2003 |
| JP | 2003-230260 | A | | 8/2003 |
| JP | 2004-011473 | A | | 1/2004 |
| JP | 2004-60532 | A | | 2/2004 |
| JP | 2004-251173 | A | | 9/2004 |
| JP | 2004-293492 | A | | 10/2004 |
| JP | 2005-188519 | A | | 7/2005 |
| JP | 2006-132419 | A | | 5/2006 |
| JP | 2006-212746 | A | | 8/2006 |
| JP | 2007-187049 | A | | 7/2007 |
| JP | 2007-228684 | A | | 9/2007 |
| JP | 2008-190444 | A | | 8/2008 |
| JP | 2009-097358 | A | | 5/2009 |
| JP | 2009-097417 | A | | 5/2009 |
| JP | 2009-162078 | A | | 7/2009 |
| JP | 2009-243363 | A | | 10/2009 |
| JP | 2009-293589 | A | | 12/2009 |
| JP | 2011-047343 | A | | 3/2011 |

OTHER PUBLICATIONS

Japanese Office Action dated Oct. 7, 2014, issued in Japanese Patent Application No. 2011-067051, with English Translation (7 pages).
Japanese Office Action dated Oct. 7, 2014, issued in Japanese Patent Application No. 2011-071495, with English Translation (6 pages).
Japanese Office Action dated Oct. 7, 2014, issued in Japanese Patent Application No. 2011-071324, with English Translation (7 pages).
International Search Report for PCT/JP2011/079468, dated Mar. 19, 2012.
Notification of Transmittal of Translation of the International Preliminary Report on Patentabililty (Form PCT/IB/338) of International Application No. PCT/JP2011/079468 dated Oct. 3, 2013 with Forms PCT/IB/373 and PCT/ISA/237.
International Search Report dated Mar. 19, 2012, issued in corresponding application No. PCT/JP2011/079463; w/English translation. (2 pages).
International Search Report issued in PCT/JP2011/079464, dated Mar. 19, 2012, w/English translation. (2 pages).
International Search Report issued in PCT/JP2011/079465, dated Mar. 19, 2012 w/English translation. (2 pages).
International Search Report issued in PCT/JP2011/079466, dated Mar. 19, 2012 w/English translation. (2 pages).
International Search Report issued in PCT/JP2011/079467, dated Mar. 19, 2012 w/English translation. (2 pages).
International Search Report issued in PCT/JP2011/079469, dated Mar. 19, 2012 w/English translation. (2 pages).
Office Action dated Apr. 27, 2015 issued in counterpart Chinese application No. 201180069296.7, with English translation. (20 pages).
Office Action dated Apr. 28, 2015 issued in counterpart Chinese application No. 201180069440.7, with English translation. (18 pages).
Office Action dated May 6, 2015 issued in counterpart Chinese application No. 201180069287.8 , with English translation. (27 pages).
Office Action dated May 26, 2015 issued in counterpart Chinese application No. 201180069545.2 , with English translation. (14 pages).
Office Action dated May 28, 2015 issued in counterpart Chinese application No. 201180069472.7, with English translation. (18 pages).

* cited by examiner

SCROLL COMPRESSION DEVICE

TECHNICAL FIELD

The present invention relates to a scroll compression device that perform compression through the engagement between a fixed scroll and a swing scroll.

BACKGROUND ART

There has been hitherto known a scroll compression device that has a compression mechanism comprising a fixed scroll and a swing scroll having mutually engageable spiral laps in a hermetically sealed casing and in which the compression mechanism is driven by a driving motor so that the swing scroll makes a circular motion with respect to the fixed scroll without rotating on its own axis, thereby performing compression (see Patent Document 1, for example).

PRIOR ART DOCUMENT

Patent Document

Patent Document 1: JP-A-2003-035289

SUMMARY OF THE INVENTION

Problem to be solved by the Invention

The scroll compression device is provided with bearings for supporting a driving shaft at the upper and lower sides of a driving motor. A thrust plate for supporting the lower end of the driving shaft is secured to a bearing plate for supporting the lower portion of the driving shaft. The weight of a driving shaft assembly containing the driving shaft and a rotor, a balancer, etc. which are integrally secured to the driving shaft is applied to a thrust face on which the thrust plate and the lower end of the driving shaft come into contact with each other. Therefore, there is a problem that a sliding loss on the thrust face of the driving shaft increases.

The present invention has an object to provide a scroll compression device that can solve the problem of the prior art described above and reduce the sliding loss on the thrust face of the driving shaft.

Means of solving the Problem

In order to attain the above object, according to the present invention, a scroll compression device is characterized in that a scroll compression mechanism for compressing refrigerant and a driving motor that is connected to the scroll compression mechanism through a driving shaft and drives the scroll compression mechanism are accommodated in a casing, the scroll compression mechanism is supported in the casing by a main frame; a stator of the driving motor is directly or indirectly supported in the casing, the driving shaft is connected to a rotor of the driving motor and supported in the casing by a bearing plate, a lower end of the driving shaft is supported by a thrust plate provided to the bearing plate, and the center position of the rotor is located to be lower than the center position of the stator.

According to the present invention, the center position of the rotor is located to be lower than the center position of the stator, resulting in occurrence of force which makes the respective center positions coincident with each other during the operation of the driving motor. Therefore, upward force acting on the rotor occurs, and the force applying to the thrust face of the thrust plate can be reduced, so that the sliding loss on the thrust face can be reduced.

In this construction, the center position of the rotor may be located to be lower than the center position of the stator in such a range that the rotor does not jump up when the driving motor is started. The center position of the rotor may be coincident with the center position of the stator so that upward force acts on the rotor during operation. The center position of the rotor may be located to be lower than the center position of the stator in such a range that the rotor can be magnetized by a voltage applied to windings of the stator when the rotor is magnetized. The stator of the driving motor may be supported in the casing by a spacer ring. The driving motor may be an inverter-controllable DC motor.

Effect of the Invention

According to the present invention, the lower end of the driving shaft is supported by the thrust plate provided to the hearing plate, and the center position of the rotor is located to be lower than the center position of the stator. Accordingly, during the operation of the driving motor, the force acts so that the respective positions are coincident with each other. Therefore, upward force is generated in the rotor, and the force acting on the thrust face of the thrust plate can be reduced, so that the sliding loss on the thrust face can be reduced.

BRIEF DESCRIPTION OF THE INVENTION

MODE FOR CARRYING OUT THE INVENTION

An embodiment according to the present invention will be described with reference to the drawings.

Figure 1:
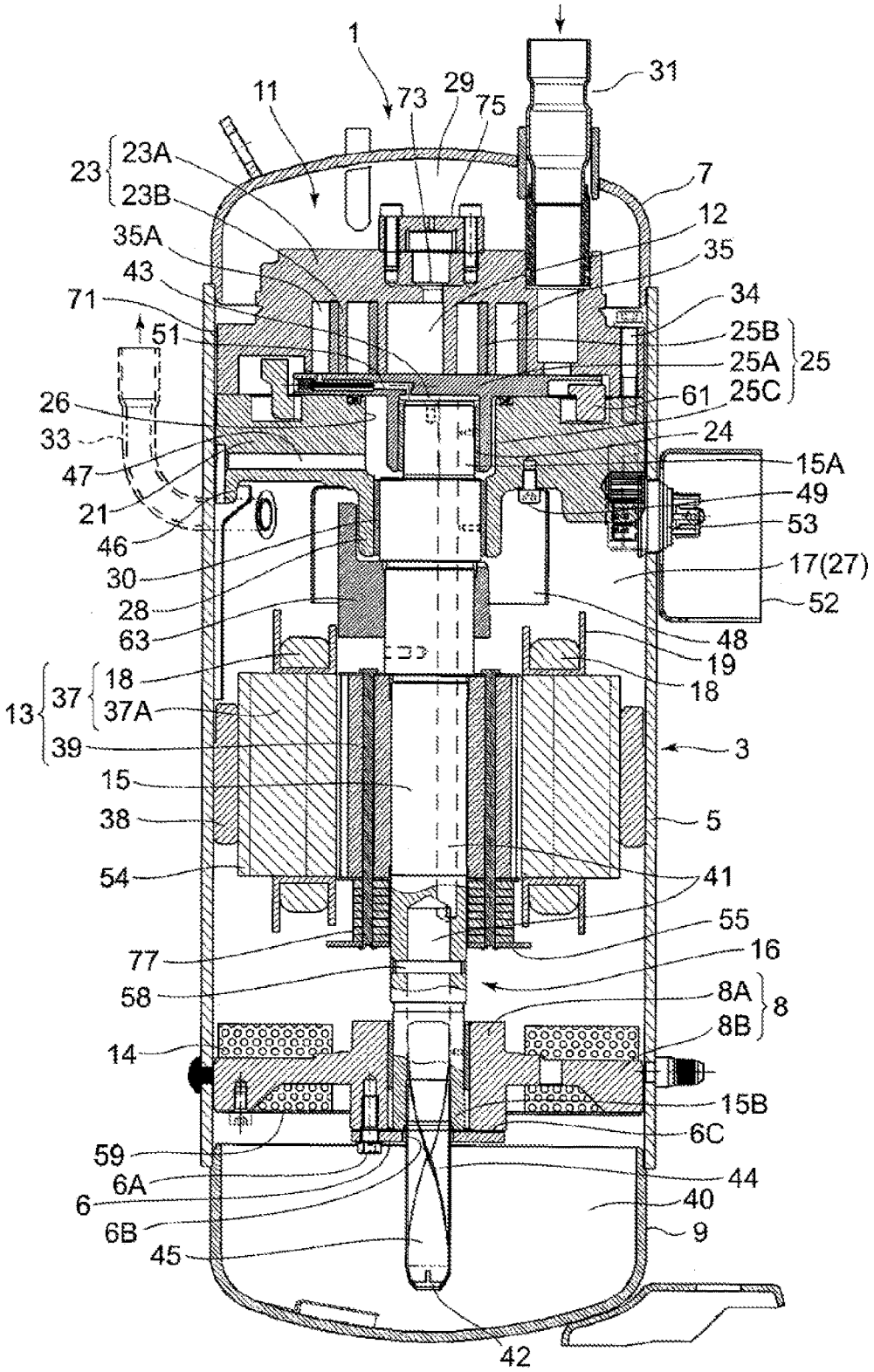
FIG. 1 is a cross-sectional view showing a scroll compression device according to an embodiment of the present invention.

In FIG. 1, reference numeral 1 represents a scroll compression device whose internal pressure is high. The compression device I is connected to a refrigerant circuit (not shown) in which refrigerant is circulated to perform a refrigeration cycle operation, and compresses the refrigerant. The compressor 1 has a hermetically-sealed doom type casing 3 having a vertically elongated cylindrical shape.

The casing 3 is configured as a pressure container comprising a casing main body 5 as a cylindrical barrel portion having an axial line extending in the up-and-down direction, a cup-shaped upper cap 7 which is air-tightly welded and integrally joined to the upper end portion of the casing main body 5 and has a convex surface protruding upwards, and a cup-shaped lower cap 9 which is air-tightly welded and integrally joined to the lower end portion of the casing main body 5 and has a convex surface protruding downwards. The inside of the casing 3 is hollow. A terminal cover 52 is provided to the outer peripheral surface of the casing 3, and a power supply terminal 53 for supplying power to a stator 37 described later is provided in the terminal cover 52.

In the casing 3 are accommodated a scroll compression mechanism 11 for compressing refrigerant and a driving motor 13 disposed below the scroll compression mechanism 11. The scroll compression mechanism. 11 and the driving motor 13 are connected to each other through a driving shaft 15 which is dispose so as to extend in the up-and-down direction in the casing 3. A gap space 17 is formed between the scroll compression mechanism 11 and the driving motor 13.

A main frame 21 is accommodated at the inner upper portion of the casing 3, and a radial bearing portion 28 and a boss mount portion 26 are formed at the center of the main frame 21. The radial bearing portion 28 pivotally supports the tip (upper end) side of the driving shaft 15, and is configured to project downwards from the center of one surface (lower side surface) of the main frame 21. The boss mount portion 26 is used to accommodate therein a boss 25C of a swing scroll 25 described later, and formed by concaving the center of the other surface (upper side surface) of the main frame 21 downwards. An eccentric shaft portion 15A is formed at the tip (upper end) of the driving shaft 15. The eccentric shaft portion 15A is provided so that the center thereof is eccentric from the shaft center of the driving shaft 15, and inserted through a slewing bearing in the boss 25C so as to be turnably driven.

The scroll compression mechanism 11 comprises a fixed scroll 23 and a swing scroll 25. The fixed scroll 23 is disposed in close contact with the upper surface of the main frame 21. The main frame 21 is secured to the inner surface of the casing main body 5, and the fixed scroll 23 is fixed to the main frame 21. The swing scroll 25 is engaged with the fixed scroll 23, and disposed in a swing space 12 formed between the fixed scroll 23 and the main frame 21. The inside of the casing 3 is partitioned into a high-pressure space 27 below the main frame 21 and a discharge space 29 above the main frame 21. The respective spaces 27 and 29 intercommunicate with each other through vertical grooves 71 which are formed on the outer peripheries of the main frame 21 and the fixed scroll 23 so as to extend vertically.

An intake pipe 31 for introducing the refrigerant in the refrigerant circuit to the scroll compression mechanism 11 air-tightly and fixedly penetrates through the upper cap 7 of the casing 3, and a discharge pipe 33 for discharging the refrigerant in the casing 3 to the outside of the casing 3 air-tightly and fixedly penetrates through the casing main body 5. The intake pipe 31 extends in the up-and-down direction in the discharge space 29, and the inner end portion thereof penetrates through the fixed scroll 23 of the scroll compression mechanism 11 and intercommunicates with the compression chamber 35, whereby the refrigerant is sucked into the compression chamber 35 through the intake pipe 31.

The driving motor (DC driving motor) 13 is a DC (Direct Current) motor which is actuated upon an input from a DC power source, and has an annular stator 37 and a rotor 39 which is freely rotatably provided in the stator 37. The driving motor 13 is operated while, the rotation torque thereof is controlled by a PWM (Pulse Width Modulation) inverter which receives a constant input voltage and controls the duty ratio of pulse waves, that is, an output period of the pulse waves and the pulse width of the output pulse waves.

The swing scroll 25 of the scroll compression mechanism 11 is operationally connected to the rotor 39 through the driving shaft 15. The stator 37 comprises a stator core 37A and a stator coil 18. The stator core 37A is formed by laminating thin iron plates and has plural grooves (not shown) therein. The stator coil 18 is formed by winding stator windings of plural phases, and provided to be fitted in the grooves formed in the stator core 37A at the upper and lower sides of the stator core 37A. The stator coil 18 is accommodated in an insulator 19. The stator 18 is connected to the power supply terminal 53 through a conductive wire (not shown).

The rotor 39 is magnetized by ferrite magnet or neodymium magnet. As a method of magnetizing the rotor 39 is known a winding magnetizing method of inserting the rotor 39 in the stator 37 and then passing current through stator windings forming the stator coil 18 of the stator 37 to magnetize the rotor 39, or an externally magnetizing method of magnetizing the rotor 39 by using an external magnetizing device and then inserting the rotor 39 in the stator 37. A holder (pin holder) 58 is press-fitted in the driving shaft 15, and used to position the rotor 39 when the winding magnetization of the rotor 39 is performed.

The stator 37 is supported on the inner wall of the casing 3 by an annular spacer ring 38. The spacer ring 38 is fixed to the inner wall surface of the casing 3 by shrinkage fitting, and the stator 37 is fixed to the inner wall surface of the spacer ring 38 by shrinkage fitting. The upper end surface of the spacer ring 38 is provided at a lower position than the upper end surface of the stator 37.

A bearing plate 8 in which the lower end portion of the driving shaft 15 is rotatably fitted and supported is provided below the driving motor 13. The bearing plate a has a boss portion 8A into which the cylindrical driving shaft 15 is fitted, and arm portions 8B which are provided at substantially equal intervals on the periphery of the boss portion 8A so as to extend in the four directions and fixed to the casing main body 5. That is, the driving shaft 15 is supported in the casing 3 by the bearing plate 8. The bearing plate 8 has an opening portion 8E which is formed among the respective arm portions 8B and through which upper and lower spaces above and below the bearing plate 8 intercommunicate with each other.

As shown in FIG. 1, the lower space (oil pool) 40 below the bearing plate 8 is kept at high pressure, and oil is pooled at the inner bottom portion of the lower cap 9 corresponding to the lower end portion of the lower space 40. An annular plate 59 is provided between the bearing plate 8 and the oil pool 40 so as to be fixed to the bearing plate 8. Furthermore, a baffle plate 14 is provided above the annular plate 59 so as to the supported by the annular plate 59. The baffle pate 14 is formed of thin plate type punching metal having many fine pores, for example.

A oil supply path 41 as a part of high-pressure oil supplying means is formed in the driving shaft 15, and the oil supply path 41 extends vertically in the driving shaft 15 and intercommunicates with an oil chamber 43 at the back side of the swing scroll 25. The oil supply path 41 is connected to an oil pickup 45 provided to the lower end of the driving shaft 15. A lateral hole 57 is provided at the back side of the oil pickup 45 so as to extend in the radial direction of the driving shaft 15 and penetrates through the oil supply path 41. The holder 58 described above is press-fitted into the lateral hole 57. The oil pickup 45 is press-fitted into the driving shaft 15 after the rotor 39 is magnetized.

The oil pickup 45 has a suction port 42 provided to the lower end thereof, and a paddle 44 formed above the suction port 42. The lower end of the oil pickup 45 is immersed in lubrication oil pooled in the oil pool 40, and the suction port 42 of the oil supply path 41 is opened in the lubrication oil. When the driving shaft 15 rotates, the lubrication oil pooled in the oil pool 40 enters the oil supply path 41 from the suction port 42 of the oil pickup 45, and is pumped up along the paddle 44 of the oil supply path 41. The thus-pumped lubrication oil is passed through the oil supply path 41, and supplied to the respective sliding portions of the scroll compression mechanism 11 such as the radial bearing portion 28, the slewing bearing 24, etc. Furthermore, the lubrication oil is supplied through the oil supply path 41 to the oil chamber 43 at the back side of the swing scroll 25, and supplied from the oil chamber 43 through an intercommunication path 51 provided to the swing scroll 25 to the compression chamber 35.

The main frame 21 penetrates radially from the boss mount portion 26 through the main frame 21 to form a return oil path 47 opened to the vertical groove 71. Excessive lubrication oil out of the lubrication oil supplied through the oil supply path 41 to the respective sliding portions of the scroll compression mechanism 11 and the compression chamber 35 is passed through the return oil path 47 and returned to the oil pool 40. An oil collect or 46 is provided below the return oil path 47, and the oil collector 46 extends to the neighborhood of the upper end of the spacer ring 38. Plural notches 54 are formed on the outer peripheral surface of the stator 37 so as to extend between the upper and lower sides of the stator 37. The lubrication oil returned from the oil supply path 41 through the return oil path 47 and the oil collector 46 is passed through the gap, which is the oil chamber, between the notches 54 and the gap between the respective arm portions B and returned to the oil pool 40. In the cross-sectional view of FIG. 1, the discharge pipe 33 is represented by broken lines for the purpose of simplification of description, but the discharge pipe 33 is disposed to be displaced in phase from the oil collector 46.

The fixed scroll 23 comprises an end plate 23A and a spiral (involute type) lap 23B formed on the lower surface of the end plate 23A. The swing scroll 25 comprises an end plate 25A and a spiral (involute type) lap 23B formed on the upper surface of the end plate 25A. The lap 23B of the fixed scroll 23 and the lap 25B of the swing scroll 25 are engaged with each other, whereby plural compression chambers 35 are formed between the fixed scroll 23 and the swing scroll 25 by both the laps 23B, 25B.

The swing scroll 25 is supported by the fixed scroll 23 through an Oldham's ring 51, and a cylindrical boss 25C having a bottom is provided to the center portion of the lower surface of the end plate 25A so as to protrude from the center portion. Furthermore, the eccentric shaft portion 15A is provided to the upper end of the driving shaft 15, and the eccentric shaft portion 15A is rotatably fitted in the swing scroll 25.

Furthermore, a counterweight portion (upper balancer) 63 is provided to the driving shaft 15 below the main frame 21, and a lower balancer 77 is provided to the lower portion of the rotor 39. The driving shaft 15 keeps dynamic balance with the swing scroll 25, the eccentric shaft portion 15A, etc. by the upper balancer 63 and the lower balancer 77.

The driving shaft 15 rotates with keeping weight balance by the counterweight portion 63 and the lower balancer 77, whereby the swing scroll is made to make an orbital motion. In connection with the orbital motion of the swing scroll 25, the compression chamber 35 is configured to compress refrigerant sucked through the suction pipe 31 by contraction of the volume between both the laps 23B, 25B to the center. A regulation plate 55 which is swaged integrally with the rotor 39 and the lower balancer 77 is provided to the lower surface of the lower balancer 77. The regulation plate 55 is used to regulate the rotation of the rotor 39 when the winding magnetization of the rotor 39 is performed.

A cup 48 is fixed to the lower side of the main frame 21 by a bolt 49 so as to surround the periphery of the counterweight portion 63. The cup 48 prevents the lubrication oil leaking from the clearance between the main frame 21 and the driving shaft 15 from scattering to the discharge pipe side due to rotation of the counterweight portion 63.

A discharge hole 73 is provided to the center portion of the fixed scroll 23, and gas refrigerant discharging from the discharge hole 73 passes through a discharge valve 75, discharges to the discharge space 29, and then flows out through the vertical grooves 71 provided on the outer peripheries of the main frame 21 and the fixed scroll 23 to the high-pressure space 27 below the main frame 21. This high-pressure refrigerant is discharged to the outside of the casing 3 through the discharge pipe 33 provided to the casing main body 5.

The driving operation of the SC roll compression device 1 will be described.

When the driving motor 13 is actuated, the rotor 39 rotates with respect to the stator 37, whereby the driving shaft 15 rotates. When the driving shaft 15 rotates, the swing scroll 25 of the scroll compression mechanism 11 makes only an orbital motion around the fixed scroll 23 without making autorotation. Accordingly, low-pressure refrigerant is passed through the suction pipe 31 and sucked from the peripheral edge side of the compression chamber 35 into the compression chamber 35. This refrigerant is compressed due to the volumetric change of the compression chamber 35, and this compressed refrigerant becomes high-pressure and is discharged from the compression chamber 35 through the discharge valve 75 to the discharge space 29, and then flows out through the vertical grooves 71 provided on the respective outer peripheries of the main frame 21 and the fixed scroll 23 to the high-pressure space 27 below the main frame 21. This high-pressure refrigerant is discharged to the outside of the casing 3 through the discharge pipe 33 provided to the casing main body 5. The refrigerant discharged to the outside of the casing 3 is circulated in the refrigerant circuit (not shown) , sucked through the suction pipe 31 into the compressor 1 and compressed again. The circulation of the refrigerant described above is repeated.

The flow of the lubrication oil will be described. The lubrication oil pooled at the inner bottom portion of the lower cap 9 in the casing 3 is sucked up by the oil pickup 45, passed through the oil supply path 41 of the driving shaft 15 and supplied to the respective sliding portions of the scroll compression mechanism 11 and the compression chamber 35. The excessive lubrication oil at the respective sliding portions of the scroll compression mechanism 11 and the compression chamber 35 is collected from the return oil path 47 to the oil collector 46, passed through the notches 54 provided on the outer periphery of the stator 37, and then returned to the lower side of the driving motor 13.

Next, the arrangement state of the driving motor 13 will be described.

A thrust plate 6 is secured to the bearing plate 8 from the lower side of the bearing plate 8 by a screw 6A. A hole 6B which is smaller in diameter than the boss portion 8A of the bearing plate 8 is formed in the thrust plate 6, and the oil pickup 45 is inserted into the driving shaft 15 through the hole 6B. The lower end 15B of the driving shaft 15 is supported by the thrust plate 6 under the state that it is mounted on a thrust face 6C which is in contact with the thrust plate 6.

Figure 2:
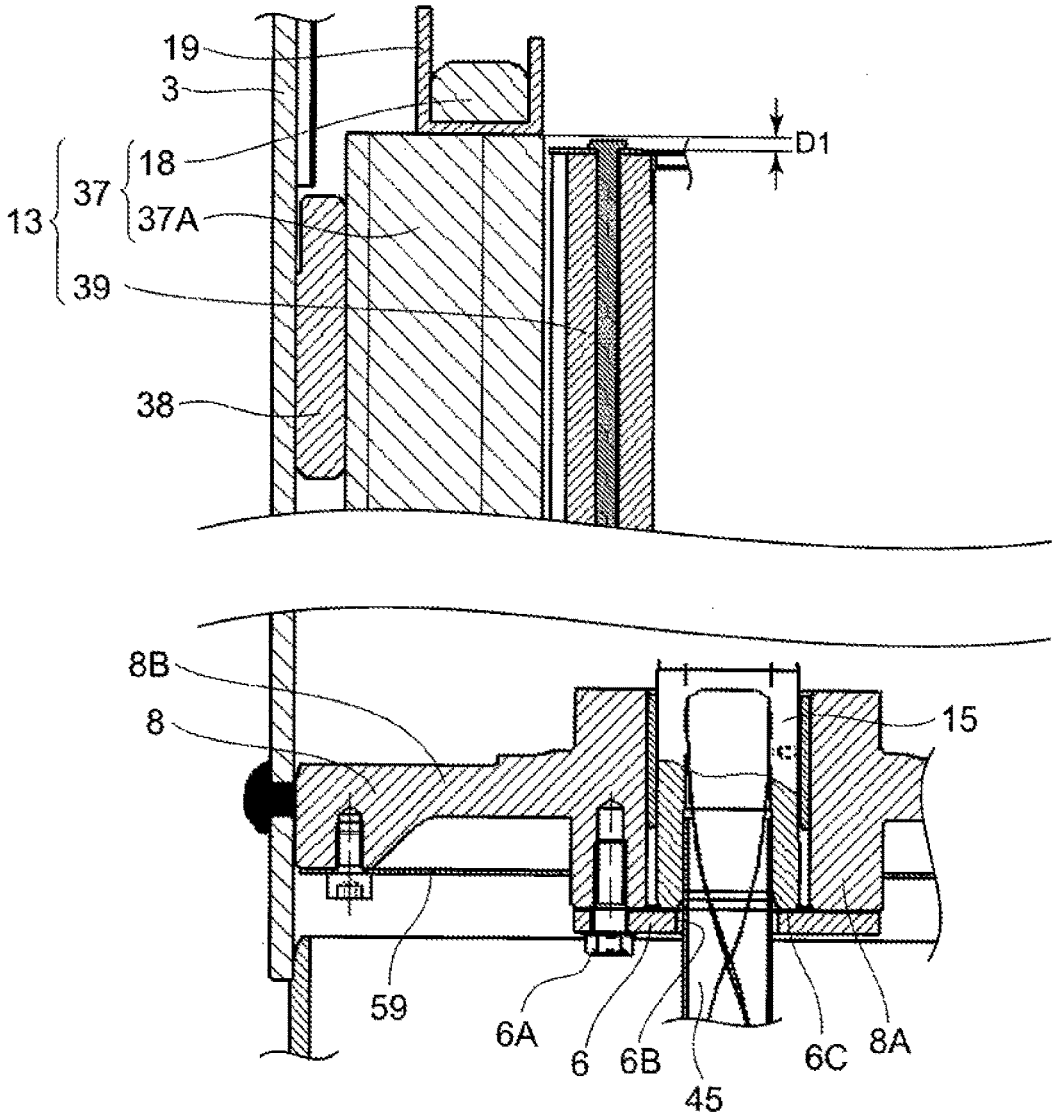
FIG. 2 is a partially enlarged cross-sectional view showing the scroll compression device under non-operation.

FIG. 2 is a diagram showing the rotor 39 and the stator 37 and the positions of the lower end of the driving shaft 15 and the thrust plate 6 when the driving motor 13 is secured to the casing 3, and is a partially enlarged cross-sectional view of the scroll compression device 1.

As shown in FIG. 2, the center position in the axial direction of the rotor 39 of the driving motor 13 is located to be lower than the center position in the axial direction of the stator 37. The center position of the rotor 39 is lower than the center position of the stator 37 in the range D1 from 0.2 mm to 2.0 mm, and the center position of the rotor 39 is most preferably lower than the center position of the stator 37 by 0.5 mm. This range D1 is set so that the driving shaft 15 does not float from the thrust face 6C, that is, the weight of the driving shaft assembly 16 is larger than upward force which upwards acts on the rotor 39 even when the driving motor 13 stably rotates. Furthermore, the lower end of the driving shaft 15 comes into contact with the thrust face 6C of the thrust plate 6.

Figure 3:
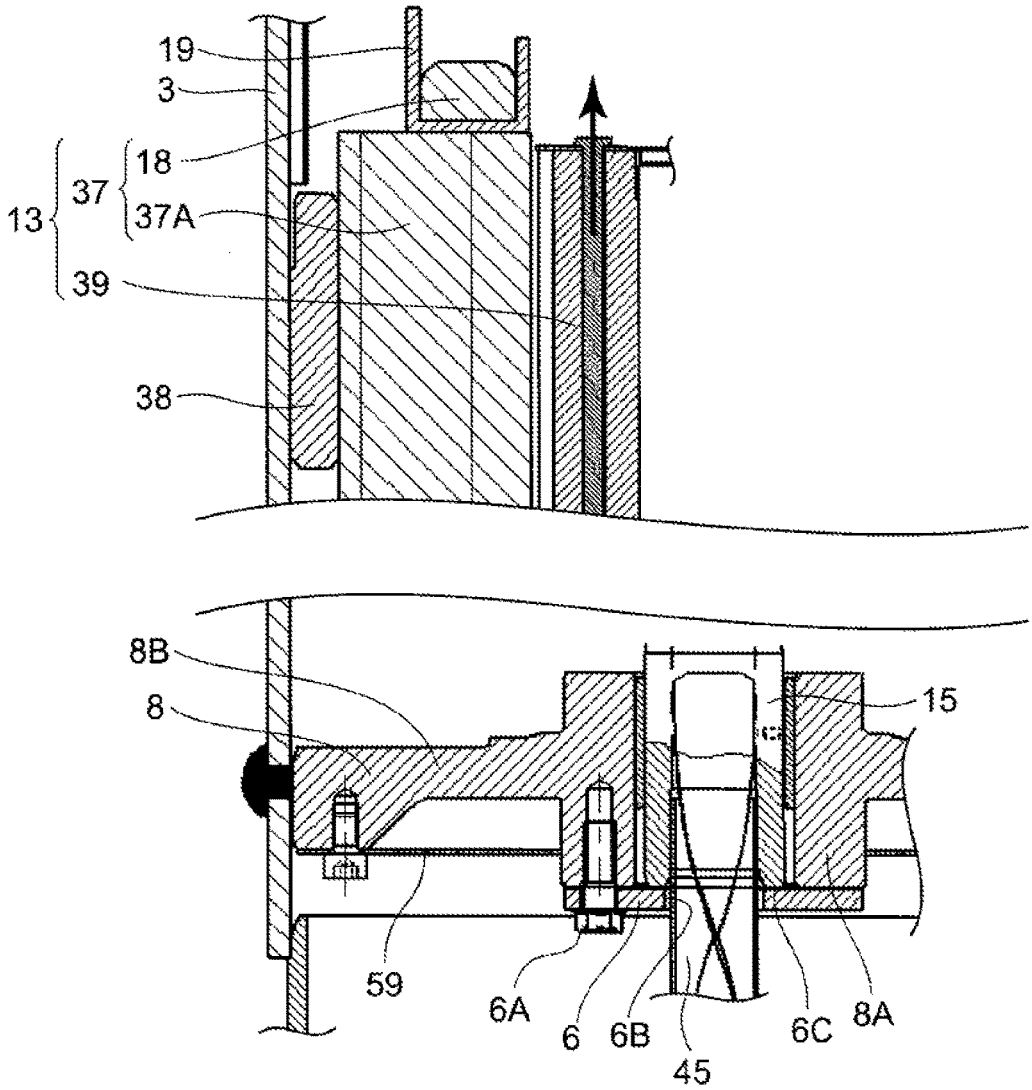
FIG. 3 is a partially enlarged cross-sectional view showing the scroll compression device under operation.

FIG. 3 is a diagram showing the rotor 39 and the stator 37 and the positions of the lower end of the driving shaft 15 and the thrust plate 6 when the driving motor 13 stably rotates, that is, the scroll compression device is under operation, and is a partially enlarged cross-sectional view of the scroll compression device 1 under operation.

When the driving motor 13 is driven to operate the scroll compression device 1 under this state, force acts on the rotor 39 so that the center position of the rotor 39 is coincident (matched) with the center position of the stator 37 during operation, and thus upward force acts on the rotor 39. Since the stator 37 is supported in the casing 3 by the spacer ring 36, the stator 37 is supported without moving even when the force for matching the respective center positions of the rotor 39 and stator 37 with each other acts. Accordingly, the weight of the driving shaft assembly 16 containing the driving shaft 15 of the driving motor 13 and the rotor 39, the upper balancer 63, the lower balancer 77, etc. which are integrally secured to the driving shaft 15 can be prevented from being applied to the thrust face 6C, and the sliding loss on the thrust face 6C can be reduced.

Furthermore, in a case where the center position of the rotor 39 is displaced from the center position of the stator 37 by a predetermined distance or more, the driving shaft assembly 16 is made to lump up by the upward force acting on the rotor 39 when large current is applied to the stator 37 a the driving time of the driving motor 13. As a reaction, the lower end of the driving shaft 15 may collide against the thrust face 6C, so that collision sound occurs. In this construction, the center position of the rotor 39 is downwardly displaced from the center position of the stator 37 in the range from 0.2 mm to 2.0 mm, whereby the driving shaft assembly 16 can be prevented from excessively jumping up when the driving motor 13 is driven, thereby preventing occurrence of collision sound caused by collision of the lower end of the driving shaft 15 against the thrust face 61C.

In order to apply a voltage to the stator coil 18 of the stator 37 to generate magnetic field in the stator core 37A and magnetize the rotor 39 by using winding magnetization, it is necessary that the displacement between the center position of the rotor 39 and the center position of the stator 37 is set to a predetermined value or less. In this construction, the center position of the rotor 39 is located to be lower than the center position of the stator 37 in the range from 0.2 mm to 2.0 mm, whereby the rotor 39 can be magnetized by using winding magnetization.

As described above, according to the embodiment to which the present invention is applied, the scroll compression mechanism 11 for compressing refrigerant and the driving motor 13 which is connected to the scroll compression mechanism 11 through the driving shaft 15 to drive the scroll compression mechanism 11 are accommodated in the casing 3, the scroll compression mechanism 11 is supported in the casing 3 by the main frame 21, the stator 37 of the driving motor 13 is directly or indirectly supported in the casing 3, the driving shaft 15 is connected to the rotor 39 of the driving motor 13, the driving shaft 15 is supported in the casing 3 by the bearing plate 8, the lower end of the driving shaft 15 is supported by the thrust plate provided to the bearing plate 8, and the center position of the rotor 39 is located to be lower than the center position of the stator 37. Accordingly, under operation of the driving motor 13, the force for matching the respective center positions with each other acts, and thus there occurs upward force with which the center position of the rotor 39 approaches to the center position of the stator 37. Therefore, the weight of the driving shaft assembly 16 containing the driving shaft 15 of the driving motor 13 and the rotor 39, the upper balancer 63, the lower balancer 77, etc. which are integrally secured to the driving shaft 15 can be prevented from being applied to the thrust plate 6, and the sliding loss on the thrust face 6C can be reduced.

Furthermore, according to the embodiment to which the present invention is applied, the center position of the rotor 39 is located to be lower than the center position of the stator 37 in the range where the rotor 39 does not lamp up when the driving motor 13 is started. Therefore, when large current is applied to the stator 37 at the driving time of the driving motor 13, the driving shaft assembly 16 can be prevented from lumping up due to the upward force acting on the rotor 39. Therefore, the lower end of the driving shaft 15 can be prevented from colliding against the thrust face 6C as a reaction to the upward jump of the driving shaft assembly 16 and generating collision sound.

Furthermore, according to the embodiment to which the present invention is applied, the force for matching the respective center positions with each other acts during the operation of the driving motor 13. Therefore, the upward force acts on the rotor 39 so as to approach the center position of the rotor 39 to the center position of the stator 37. Accordingly, the weight of the driving shaft 15 of the driving motor 13 and the rotor 39, the upper balancer 63, the lower balancer 77, etc. which are integrally secured to the driving shaft 15 can be prevented from being applied to the thrust plate 6, and thus the sliding loss on the thrust face 6C can be reduced.

Still furthermore, according to the embodiment to which the present invention is applied, the center position of the rotor 39 can be set to be lower than the center position of the stator 37 to the extent that the rotor 39 can be magnetized by the voltage applied to the windings of the stator 37 when the rotor 39 is magnetized. Therefore, the rotor 39 of the driving motor 13 secured to the casing 3 can be magnetized by using winding magnetization.

Still furthermore, according to the embodiment to which the present invention is applied, the stator 37 of the driving motor 13 is supported in the casing by the spacer ring 38. Therefore, even when downward force acts on the stator 37 during the operation of the driving motor 13, the center position of the rotor 39 and the center position of the stator 37 can be made coincident with each other by the upward force acting on the rotor because the stator 37 is supported in the casing by the spacer ring 38. Therefore, the weight of the driving shaft assembly 16 containing the driving shaft 15 of the driving motor 13 and the rotor 39, the upper balancer 63, the lower balancer 77, etc. which are integrally secured to the driving shaft 15 can be prevented from acting on the thrust plate 6 by the upward force acting on the rotor 39, so that the sliding loss on the thrust face 6C can be reduced.

Furthermore, the driving motor 13 is a DC motor whose rotation torque is controlled by a PWM inverter. Therefore, the driving motor 13 can be miniaturized by using a driving motor having a high output efficiency. Still furthermore, the driving motor is driven by the inverter, occurrence of needless heat caused by increase/decrease of the voltage of the driving motor 13 can be prevented, and the driving efficiency can be enhanced.

DESCRIPTION OF REFERENCE NUMERALS

1 scroll compression device
3 casing
6 thrust plate
6C thrust face
8 bearing plate
11 scroll compression mechanism
13 driving motor (DC driving motor
15 driving shaft
21 main frame
37 stator
38 spacer ring
39 rotor

The invention claimed is:

1. A scroll compression device comprising:

a scroll compression mechanism for compressing refrigerant and a driving motor, which is connected to the scroll compression mechanism through a driving shaft, and drives the scroll compression mechanism, the scroll compression mechanism and the driving shaft are accommodated in a casing, the scroll compression mechanism being pivotally connected to the driving shaft through a slewing bearing;

the scroll compression mechanism that is supported in the casing by a main frame;

a stator of the driving motor is directly or indirectly supported in the casing;

the driving shaft is connected to a rotor of the driving motor, an upper side of the driving shaft is pivotally supported by the main frame through a bearing portion, a lower end portion of the driving shaft is pivotally supported in the casing by a bearing plate, and a lower end of the driving shaft is disposed on and supported by a trust face of a thrust plate provided to the bearing plate; and an oil pickup that sucks up a lubrication oil pooled at the inner bottom portion of the casing is inserted into the driving shaft through a hole formed in the thrust plate;

wherein the scroll compression mechanism comprises a fixed scroll and a swing scroll, the swing scroll comprises an end plate and an involute type lap formed on an upper surface of the end plate, an eccentric shaft portion is formed at an upper end of the driving shaft, the eccentric shaft portion is provided so that a center thereof is eccentric from a shaft center of the driving shaft, and is inserted through the slewing bearing in a boss portion that protrudes from a lower surface of the end plate so as to be turnably driven, a gap, which is an oil chamber, is provided between an upper end surface of the eccentric shaft portion of the driving shaft and the lower surface of the end plate of the scroll compression mechanism, at least the driving shaft, the rotor and the oil pickup configure a driving shaft assembly, and a center position of the rotor is located to be lower than a center position of the stator in a range from a lower limit of 0.2mm to an upper limit of 2.0mm, the upper limit being a value in which the driving shaft assembly is prevented from jumping up when the driving motor is started and the lower limit being a value in which weight of the driving shaft assembly is larger than upward force which upwards acts on the rotor when the driving motor rotates so that the lower end of the driving shaft is in contact with the thrust face of the thrust plate, the casing has a vertically elongated cylindrical shape and comprises a spacer ring, which is an annular spacer ring, the spacer ring is fixed to an inner wall surface of the casing over a circumferential direction of the inner wall surface of the casing, and the stator is fixed to an inner wall surface of the spacer ring over a circumferential direction of the inner wall surface of the spacer ring.

2. The scroll compression device according to claim 1, wherein the center position of the rotor is coincident with the center position of the stator and an upward force acts on the rotor during an operation.

3. The scroll compression device according to claim 1, wherein the center position of the rotor is located to be lower than the center position of the stator in such a range that the rotor can be magnetized by a voltage applied to windings of the stator when the rotor is magnetized.

4. The scroll compression device according to claim 2, wherein the center position of the rotor is located to be lower than the center position of the stator in such a range that the rotor can be magnetized by a voltage applied to windings of the stator when the rotor is magnetized.

* * * * *